US008505522B2

(12) United States Patent
Shin

(10) Patent No.: US 8,505,522 B2
(45) Date of Patent: Aug. 13, 2013

(54) PCV VALVE

(75) Inventor: Bosung Shin, Suwon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 114 days.

(21) Appl. No.: 13/189,381

(22) Filed: Jul. 22, 2011

(65) Prior Publication Data

US 2012/0138031 A1 Jun. 7, 2012

(30) Foreign Application Priority Data

Dec. 1, 2010 (KR) ..... 10-2010-0121628

(51) Int. Cl.
*F01M 13/00* (2006.01)

(52) U.S. Cl.
USPC ..... 123/574

(58) Field of Classification Search
USPC ..... 123/572–574, 41.86; 137/543.23, 137/502
See application file for complete search history.

(56) References Cited

U.S. PATENT DOCUMENTS

| | | | | | |
|---|---|---|---|---|---|
| 3,111,138 | A * | 11/1963 | Humphrcys et al. | ..... | 137/480 |
| 3,581,721 | A * | 6/1971 | Horiuchi | ..... | 123/574 |
| 3,599,667 | A * | 8/1971 | Kaser | ..... | 137/480 |
| 3,662,724 | A * | 5/1972 | Ohar et al. | ..... | 123/574 |
| 3,766,898 | A * | 10/1973 | McMullen | ..... | 123/574 |
| 4,056,085 | A * | 11/1977 | Nowroski et al. | ..... | 123/574 |
| 4,625,703 | A * | 12/1986 | Otto et al. | ..... | 123/574 |
| 4,686,952 | A * | 8/1987 | Zeigler et al. | ..... | 123/572 |
| 6,546,921 | B1 * | 4/2003 | Callahan | ..... | 123/573 |
| 6,820,601 | B1 * | 11/2004 | Price et al. | ..... | 123/574 |
| 7,131,433 | B1 * | 11/2006 | Lindberg et al. | ..... | 123/572 |
| 2008/0257320 | A1 * | 10/2008 | Asanuma et al. | ..... | 123/573 |
| 2010/0139634 | A1 * | 6/2010 | Wade | ..... | 123/574 |

FOREIGN PATENT DOCUMENTS

| | | | |
|---|---|---|---|
| JP | 10-047032 | A | 2/1998 |
| JP | 2005-240605 | A | 9/2005 |
| KR | 10-0876469 | B1 | 12/2008 |
| KR | 100876466 | B1 | 12/2008 |
| KR | 1020100033078 | A | 3/2010 |

* cited by examiner

*Primary Examiner* — M. McMahon
(74) *Attorney, Agent, or Firm* — Morgan, Lewis & Bockius LLP

(57) ABSTRACT

A PCV valve includes a cover of which an inlet is formed thereto, a body connected to the cover to form a hydraulic path therein and the body of which an outlet is formed thereto, a valve body including a valve head and disposed within the hydraulic path for the valve head to selectively block the inlet and an elastic portion which contacts the valve head and elastically supports the valve body within the hydraulic path, wherein a valve head gas groove is formed to a surface of the valve head that contacts the elastic portion.

4 Claims, 7 Drawing Sheets

PCV VALVE

CROSS-REFERENCE TO RELATED APPLICATION

This application claims priority to and the benefit of Korean Patent Application No. 10-2010-0121628 filed Dec. 1, 2010, the entire contents of which application is incorporated herein for all purposes by this reference.

BACKGROUND OF INVENTION

1. Field of Invention

The present invention relates to a PCV valve. More particularly, the present invention relates to a PCV valve which may not block flowing of blow-by gas and may prevent noise and abrasion.

2. Description of Related Art

A general blow-by system allows combustion blow-by gases to escape from the engine crankcase without getting released into the environment and to return to an intake manifold through a head cover and the blow-by system includes a PCV (Positive Crankcase Ventilation) valve which controls flowing of blow-by gases.

FIG. 7 is a cross-sectional view of a general PCV valve.

Referring to FIG. 7, a general PCV valve includes a cover 110 of which an inlet 112 is formed thereto and a body 120 of which an outlet 122 is formed thereto and the body 120 is connected to the cover 110 and an orifice 160 which is disposed therein.

A valve body 130 is elastically supported by a valve spring 140 and the valve spring 140 is compressed according to pressure differences between the outlet 122 connected to an intake manifold (not shown) and the inlet 112 connected to a head cover (not shown) and then blow-by gas flows into the intake manifold.

However, if pressure differences between the outlet 122 and the inlet 112 are increased, the valve spring 140 may be completely compressed so as to block flowing of the blow-by gas or the valve body 130 may block a hole formed to the orifice 160 or the outlet 122.

To solve those problems, as shown in FIG. 7, a spring 150 is provided near the outlet 122 or a stopper (not shown) is provided.

However, the general PCV valve further includes a cushion spring and elements for configuring the cushion spring and thus element numbers are increased and also production cost is increased.

And also, if a stopper and so on is configured, element numbers are increased and noise and abrasion induced by impacts of the stopper may be occurred.

The above information disclosed in this Background section is only for enhancement of understanding of the background of the invention and therefore it may contain information that does not form the prior art that is already known in this country to a person of ordinary skill in the art.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a PCV valve having advantages of not blocking flowing of blow-by gas and preventing noise and abrasion.

The PCV valve according to various embodiments of the present invention may include a cover of which an inlet is formed thereto, a body connected to the cover to form a hydraulic path therein and the body of which an outlet is formed thereto, a valve body including a valve head and disposed within the hydraulic path for the valve head to selectively block the inlet and an elastic portion which contacts the valve head and elastically supports the valve body within the hydraulic path, wherein a valve head gas groove is formed to a surface of the valve head that contacts the elastic portion.

The valve head gas groove may be formed to along a diameter direction of the valve head.

The PCV valve may further include an orifice which is disposed within the hydraulic path and of which an orifice hole for the valve body to be inserted thereinto is formed.

The elastic portion may be disposed between the orifice and the valve body.

An orifice gas groove may be formed to a surface of the orifice that contacts the elastic portion.

The orifice gas groove may be formed to along a diameter direction of the orifice.

The PCV valve may further include a seal ring which is disposed to a portion where the cover and the body are connected.

According to various embodiments of the present invention, flowing of blow-by gas may not be blocked and generating of noise and abrasion may be prevented.

The PCV valve according to various embodiments of the present invention may reduce element numbers and production cost.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
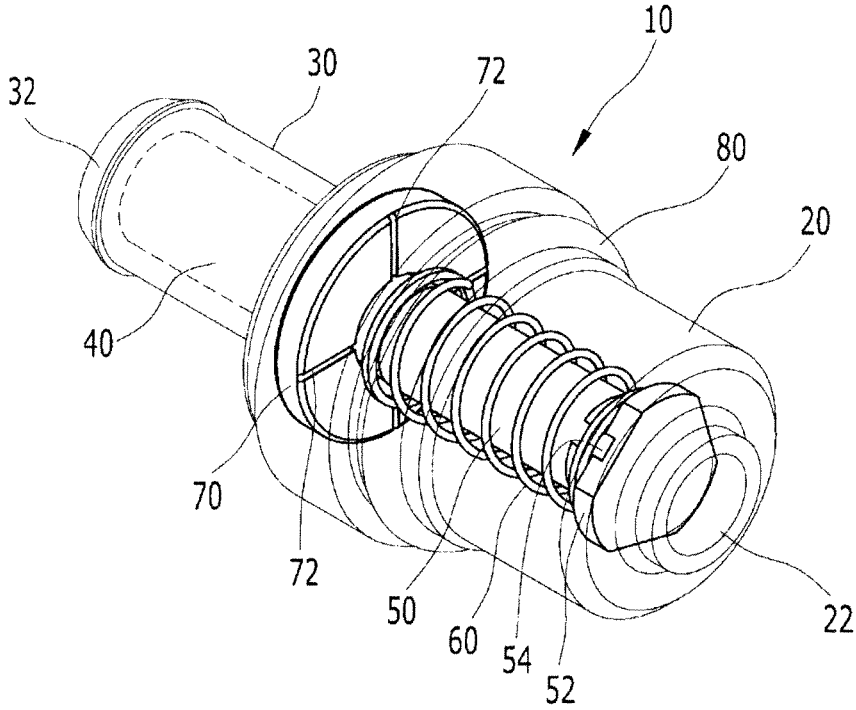
FIG. 1 is a drawing showing an exemplary PCV valve according to the present invention.
Figure 2:
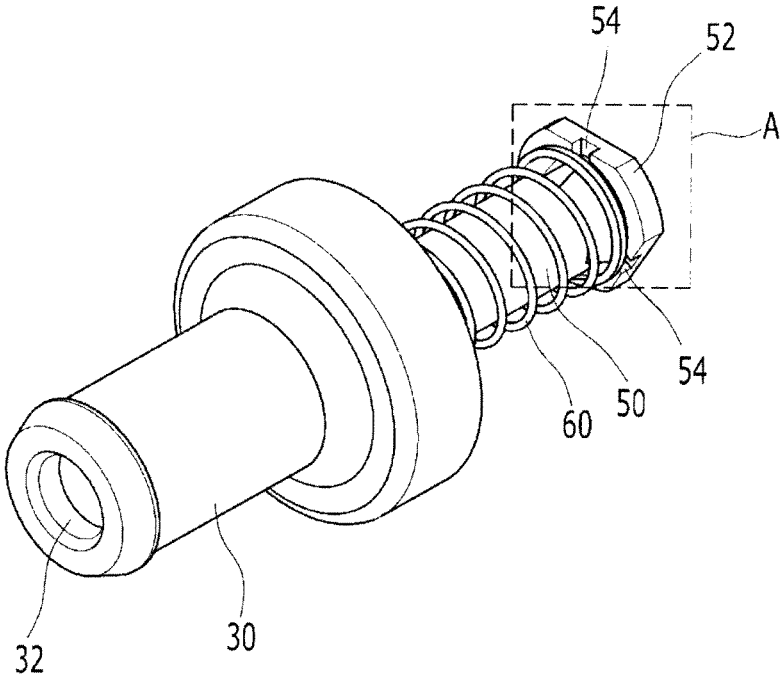
FIG. 2 is a partial perspective view showing an exemplary PCV valve according to the present invention.
Figure 3:
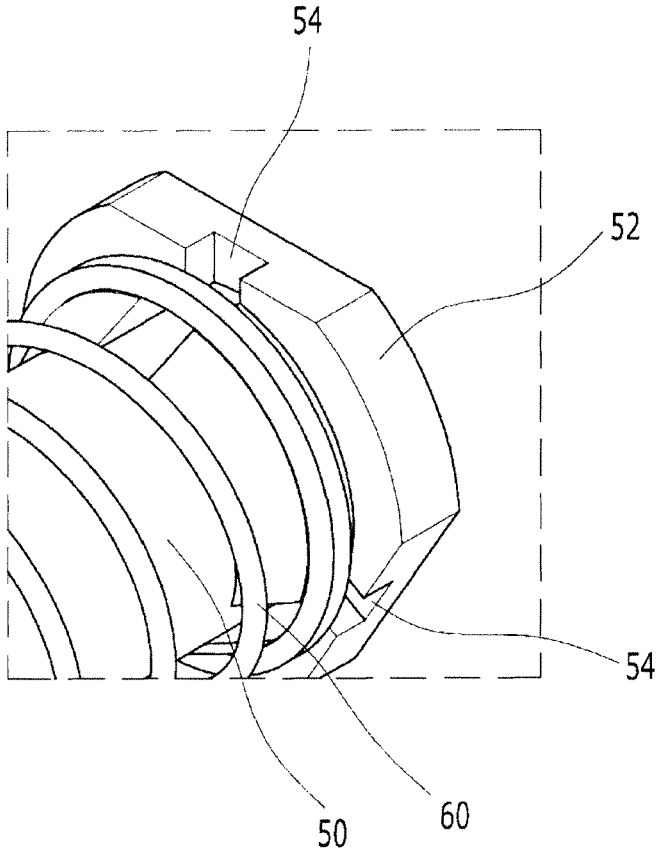
FIG. 3 is a partial enlarged view of A of FIG. 2.

FIG. 1 is a drawing showing a PCV valve according to various embodiments of the present invention, FIG. 2 is a partial perspective view showing a PCV valve according to various embodiments of the present invention, and FIG. 3 is a partial enlarged view of A of FIG. 2.

Referring to FIG. 1 to FIG. 3, a PCV valve 10 according to various embodiments of the present invention include a cover 20 of which an inlet 22 is formed thereto, a body 30 connected to the cover 20 to form a hydraulic path 40 therein and the body 30 of which an outlet 32 is formed thereto, a valve body 50 including a valve head 52 and disposed within the hydraulic path 40 for the valve head 52 to selectively block the inlet 22 and an elastic portion 60 which contacts the valve head 52 and elastically supports the valve body 50 within the hydraulic path 40, wherein a valve head gas groove 54 is formed to a surface of the valve head 52 that contacts the elastic portion 60.

In this case, the hydraulic path 40 may be defined as a space of which blow-by gas flows.

The valve head gas groove 54 may be formed to along a diameter direction of the valve head 52.

The PCV valve 10 further includes a seal ring 80 which is disposed to a portion where the cover 20 and the body 30 are connected for preventing gas from leaking.

Figure 4:
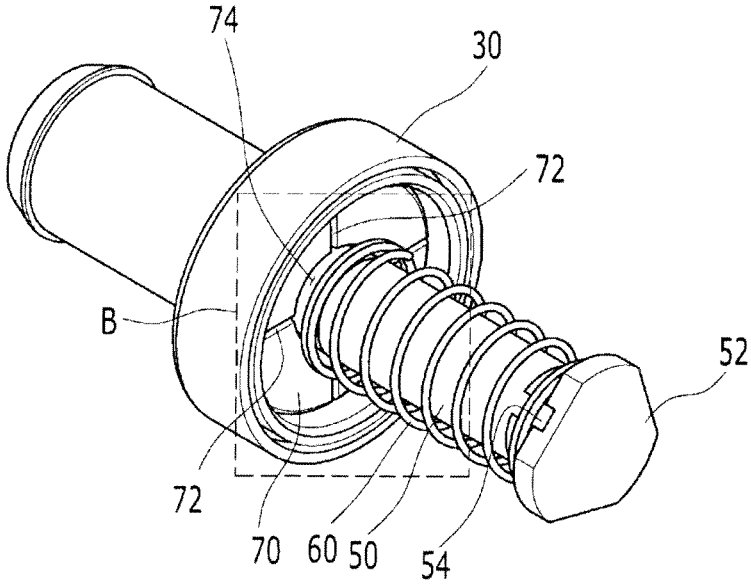
FIG. 4 is another partial perspective view showing an exemplary PCV valve according to the present invention.
Figure 5:
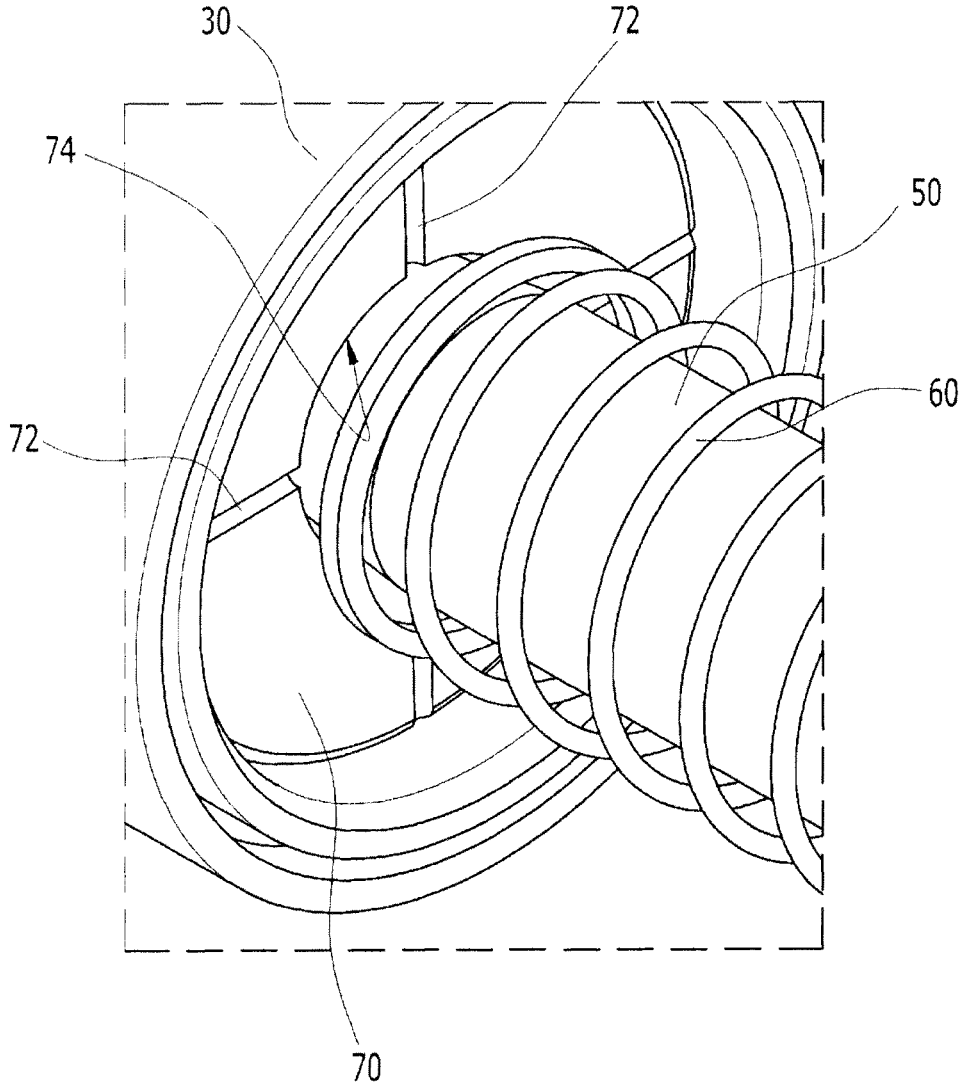
FIG. 5 is a partial enlarged view of B of FIG. 4.
Figure 6:
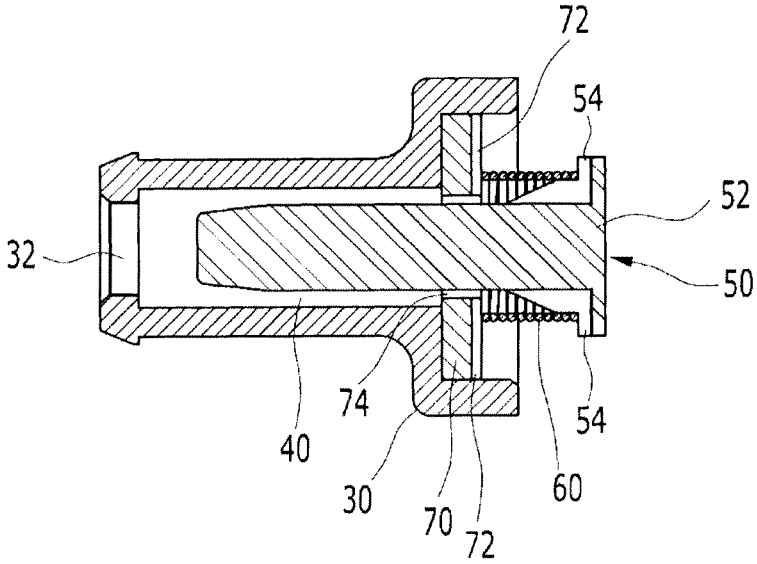
FIG. 6 is a cross-sectional view of an exemplary PCV valve according to the present invention.
Figure 7:
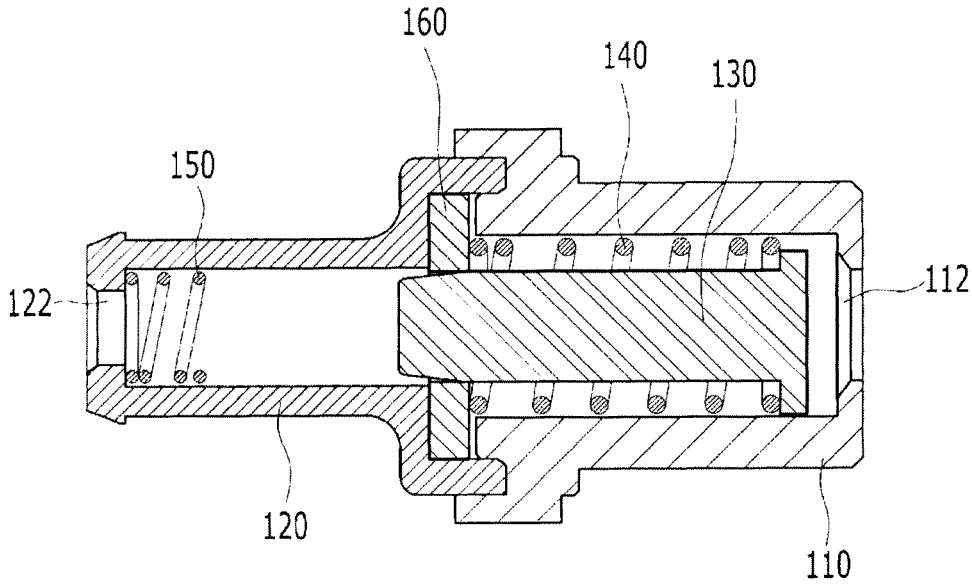
FIG. 7 is a cross-sectional view of a conventional PCV valve.

FIG. 4 is another partial perspective view showing a PCV valve according to various embodiments of the present invention, FIG. 5 is a partial enlarged view of B of FIG. 4, and FIG. 6 is a cross-sectional view of a PCV valve according to various embodiments of the present invention.

Referring to FIG. 1 to FIG. 6, the PCV valve 10 further includes an orifice 70 which is disposed within the hydraulic path 40 and of which an orifice hole 74 for the valve body 50 to be inserted thereinto is formed.

The elastic portion 60 is disposed between the orifice 70 and the valve body 50.

An orifice gas groove 72 is formed to a surface of the orifice 70 that contacts the elastic portion 60.

The orifice gas groove 72 is formed to along a diameter direction of the orifice 70.

Hereinafter, referring to FIG. 1 to FIG. 6, operations of the PCV valve according to various embodiments of the present invention will be described.

If pressure differences between the outlet 32 and the inlet 22 are increased according to engine operations, the elastic portion 60 such as a spring is compressed and the valve body 50 is opened for the blow-by gas to flow.

As shown in FIG. 6, if the pressure differences between the outlet 32 and the inlet 22 are increased and the spring 60 is completely compressed, there is no gap between pitches of the spring 60. However, the blow-by gas may flow through the valve head gas groove 54 of the PCV valve 10.

And also, although the spring 60 is completely compressed, the blow-by gas may flow through the orifice gas groove 72 and the orifice hole 74.

As described above, the PCV valve according to various embodiments of the present invention may reduce element numbers and production cost without a cushion spring and elements for equipping the cushion spring and so on.

And also, stoppers and so on are not required, and thus element numbers and production cost may be reduced and the valve body may not impact a stopper and so on, and thus noise and abrasion may be prevented.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A PCV valve comprising:

a cover including an inlet formed therein;

a body connected to the cover to form a hydraulic path therein, wherein the body includes an outlet formed in an end of the body;

a valve body including a valve head disposed within the hydraulic path to selectively block the inlet; and an elastic portion which contacts the valve head and elastically supports the valve body within the hydraulic path in the cover; and wherein a valve head gas groove is formed in an inner surface of the valve head that contacts the elastic portion;

wherein the PCV valve further includes an orifice disposed in the hydraulic path and an orifice hole formed in the orifice receives the valve body therethrough, wherein an inner diameter of the orifice hole is larger than an outer diameter of the valve body to allow a blow-by gas flow through a space formed between the valve body and the orifice hole;

wherein the elastic portion is disposed between the orifice and the valve body;

wherein an orifice gas groove is formed on a surface of the orifice that contacts the elastic portion and continuously fluid-communicates with the space formed between the orifice hole and the valve body; and wherein the orifice gas groove is formed in a radial direction of the orifice.

2. The PCV valve of claim 1, wherein the valve head gas groove is formed in a radial direction of the valve head.

3. The PCV valve of claim 1, wherein the PCV valve further comprises a seal ring which is disposed on a portion interconnecting the cover and the body.

4. The PCV valve of claim 1, wherein the valve head gas groove continuously fluid-communicates with the space formed between the orifice hole and the valve body.

* * * * *